US008668114B2

(12) United States Patent
Gelardi et al.

(10) Patent No.: US 8,668,114 B2
(45) **Date of Patent: *Mar. 11, 2014**

(54) DISPENSING SYSTEM AND PACKAGE FOR USE THEREWITH

(75) Inventors: John Gelardi, Midlothian, VA (US); Laurel Thomas, Richmond, VA (US)

(73) Assignee: MeadWestvaco Corporation, Richmond, VA (US)

( * ) Notice: Subject to any disclaimer, the term of this patent is extended or adjusted under 35 U.S.C. 154(b) by 374 days.

This patent is subject to a terminal disclaimer.

(21) Appl. No.: 13/098,786

(22) Filed: May 2, 2011

(65) Prior Publication Data

US 2012/0279893 A1 Nov. 8, 2012

(51) Int. Cl.
*B65H 1/00* (2006.01)
*A47F 1/04* (2006.01)

(52) U.S. Cl.
USPC ..... 221/285; 221/287; 221/305; 221/31; 211/59.2

(58) Field of Classification Search
USPC ..... 221/31, 32, 197, 285, 287, 305; 211/59.2
See application file for complete search history.

(56) References Cited

U.S. PATENT DOCUMENTS

| | | | |
|---|---|---|---|
| 902,347 | A | 10/1908 | Tillinghast |
| 1,291,420 | A | 1/1919 | Cough |
| 1,383,318 | A | 7/1921 | McCormick |
| 1,393,964 | A | 10/1921 | Potts et al. |
| 1,753,957 | A | 4/1930 | Washburn |
| 1,824,937 | A | 9/1931 | Trouth |
| 1,858,199 | A | 10/1932 | Maziroff |
| 1,898,056 | A | 2/1933 | Johnson |
| 1,919,907 | A | 7/1933 | Robinson |
| 1,932,225 | A | 10/1933 | Minter |
| 1,941,458 | A | 2/1934 | Bens |
| 1,985,739 | A | 12/1934 | Murray |
| 2,078,599 | A | 4/1937 | McCauley |
| 2,110,194 | A | 3/1938 | Blier |
| 2,263,353 | A | 11/1941 | Eidam |
| 2,291,187 | A | 7/1942 | Johnson |

(Continued)

FOREIGN PATENT DOCUMENTS

| | | |
|---|---|---|
| AT | 6036 U1 | 3/2003 |
| DE | 2655496 | 6/1978 |

(Continued)

OTHER PUBLICATIONS

International Search Report and Written Opinion issued in PCT/US2010/057020 (Mar. 8, 2011).

(Continued)

*Primary Examiner* — Timothy Waggoner
(74) *Attorney, Agent, or Firm* — MeadWestvaco Intellectual Property Group

(57) ABSTRACT

An improved dispensing system for dispensing products provided initially in a package that includes an activatable opening structure is disclosed. The dispensing system comprises a frame being configured to support the package of products and an opening tool associated with the frame. The opening tool engages with the activatable opening structure on the package to create an opening when the package is moved longitudinally along the frame of the dispensing system, thus allowing the products to be at least partially dispensed out of the package into the product display area of the frame through the opening formed on the rear panel or on an angular of the rear and side panels of the package.

23 Claims, 11 Drawing Sheets

(56) References Cited

U.S. PATENT DOCUMENTS 2,382,191 A 7/1944 Weichselbaum
2,536,421 A 2/1951 Burhans
2,573,381 A 10/1951 Arnold
2,574,087 A 11/1951 Burhans
2,595,122 A 4/1952 Burhans
2,732,619 A 1/1956 Labine
2,784,871 A 3/1957 Gabrielsen
2,795,845 A 6/1957 Shimer
2,818,978 A 1/1958 Post
2,826,471 A 3/1958 Fonda
2,831,591 A 4/1958 Morton
2,888,145 A 5/1959 Knott et al.
2,915,162 A 12/1959 Umstead
2,915,932 A 12/1959 Gross
2,919,488 A 1/1960 Brownlee
2,996,344 A 8/1961 Garman
3,018,149 A 1/1962 Parker
3,055,293 A 9/1962 Lariccia
3,066,827 A 12/1962 Pryor
3,137,068 A 6/1964 Quigley
D198,888 S 8/1964 Heselov
3,178,242 A 4/1965 Ellis et al.
3,184,104 A 5/1965 De Domenico et al.
3,203,554 A 8/1965 Pendergrast et al.
3,204,335 A 9/1965 Hughes
3,288,544 A 11/1966 Knecht
3,300,115 A 1/1967 Schauer
3,304,141 A 2/1967 Rogers
3,306,688 A 2/1967 Di Domenico
3,318,455 A 5/1967 Takahashi
3,335,940 A 8/1967 Dykes
3,340,790 A 9/1967 Simjian
3,348,738 A 10/1967 Hertlein
3,392,901 A 7/1968 Krzyzanowski
3,393,808 A 7/1968 Chirchill
3,501,016 A 3/1970 Eaton
3,664,545 A 5/1972 Beesley
3,763,557 A 10/1973 Sewell
3,784,022 A 1/1974 Beesley, Jr.
3,922,778 A 12/1975 Aalpoel
3,923,159 A * 12/1975 Taylor et al. ..... 211/59.2
3,972,454 A 8/1976 Croley
4,105,126 A 8/1978 Deffner et al.
4,205,440 A 6/1980 Morgan
4,260,072 A 4/1981 Quasarano
4,318,458 A 3/1982 Ritsema
4,382,526 A 5/1983 Stone
4,396,143 A 8/1983 Killy
4,435,026 A 3/1984 Johnson
4,456,147 A 6/1984 Tominaga
4,467,524 A 8/1984 Ruff et al.
4,576,272 A 3/1986 Morgan, Jr.
4,598,828 A 7/1986 Young et al.
4,729,480 A 3/1988 Groover et al.
4,744,489 A 5/1988 Binder et al.
4,834,263 A 5/1989 Becze
4,869,395 A 9/1989 Rubbmark
4,911,309 A 3/1990 Stefan
4,915,571 A 4/1990 Toshihiko et al.
4,923,070 A 5/1990 Jackle et al.
4,997,106 A 3/1991 Rockola
4,998,628 A * 3/1991 Ross ..... 211/59.2
5,033,348 A 7/1991 Walsh
5,080,256 A 1/1992 Rockola
5,101,703 A 4/1992 Tanaka et al.
5,167,345 A 12/1992 Bleeker
5,190,155 A 3/1993 Grunwald
5,251,972 A 10/1993 Zurawin
5,289,943 A 3/1994 Powell
5,314,078 A 5/1994 Morikiyo et al.
5,328,258 A 7/1994 Scalise
5,356,033 A 10/1994 Delaney
5,372,278 A 12/1994 Leight
5,390,821 A 2/1995 Markel
5,396,997 A 3/1995 Johnson
D363,174 S 10/1995 Fletcher, Sr.
5,462,198 A 10/1995 Schwimmer
5,529,207 A 6/1996 Oden et al.
5,638,988 A 6/1997 Rogers
5,685,664 A 11/1997 Parham et al.
5,740,610 A 4/1998 Ayer et al.
5,788,117 A 8/1998 Zimmanck
5,791,048 A 8/1998 Bodnar et al.
5,836,478 A 11/1998 Weiss
5,878,862 A 3/1999 Dewsnap
5,894,942 A 4/1999 Miyashita et al.
5,924,573 A 7/1999 Piraneo et al.
5,992,286 A 11/1999 Boole
5,992,652 A 11/1999 Springs
6,186,345 B1 2/2001 Robertson
6,199,720 B1 3/2001 Rudick et al.
6,206,237 B1 3/2001 Dillon et al.
6,253,930 B1 7/2001 Freidus et al.
6,267,258 B1 7/2001 Wilkerson et al.
6,393,799 B2 5/2002 Jenkins et al.
6,453,641 B1 9/2002 Puckett
6,637,604 B1 10/2003 Jay
6,802,433 B2 10/2004 Leykin
6,991,116 B2 1/2006 Johnson et al.
7,207,447 B2 4/2007 Medcalf et al.
7,303,095 B2 12/2007 Nagelski et al.
D588,386 S 3/2009 Johnson et al.
D595,074 S 6/2009 Johnson et al.
7,546,973 B2 6/2009 Budz et al.
7,584,854 B2 9/2009 Chandaria
7,614,543 B1 11/2009 Miller
D604,972 S 12/2009 Henry et al.
7,665,618 B2 2/2010 Jay et al.
7,681,745 B2 3/2010 Richter
7,690,518 B2 4/2010 Fincher et al.
7,757,890 B2 7/2010 Alford et al.
D621,644 S 8/2010 Johnson
7,810,672 B1 10/2010 Mason et al.
7,823,733 B2 11/2010 Futori
7,841,479 B2 11/2010 Budge et al.
7,850,015 B1 12/2010 Mason
7,913,860 B2 3/2011 Merl
7,918,365 B2 4/2011 White et al.
7,922,437 B1 * 4/2011 Loftin et al. ..... 414/412
7,992,747 B2 * 8/2011 Bauer ..... 221/197
8,028,855 B2 10/2011 White et al.
8,047,400 B1 11/2011 Luberto et al.
8,302,809 B1 * 11/2012 Bogdziewicz et al. ..... 221/31
8,308,023 B2 * 11/2012 Gelardi et al. ..... 221/31
8,322,543 B2 * 12/2012 Gelardi et al. ..... 211/59.2
2002/0043509 A1 4/2002 Lajeunesse et al.
2003/0173322 A1 9/2003 Rushing
2004/0011751 A1 1/2004 Johnson et al.
2004/0040334 A1 3/2004 Rusnock
2004/0079760 A1 4/2004 Rink
2004/0262326 A1 12/2004 Christensen
2005/0092644 A1 5/2005 Cafferata
2005/0127015 A1 6/2005 Medcalf et al.
2005/0207877 A1 9/2005 Haverdink
2006/0081692 A1 4/2006 Stewart et al.
2006/0237384 A1 10/2006 Neumann et al.
2006/0243683 A1 11/2006 Onachilla et al.
2006/0278591 A1 12/2006 Tippets et al.
2007/0194037 A1 8/2007 Close
2008/0245813 A1 10/2008 Johnson et al.
2009/0039040 A1 2/2009 Johnson et al.
2009/0212066 A1 8/2009 Bauer
2009/0266776 A1 10/2009 Johnson
2009/0277853 A1 11/2009 Bauer
2009/0308885 A1 12/2009 Sainato et al.
2010/0032391 A1 2/2010 Schneider et al.
2010/0096401 A1 4/2010 Sainato et al.
2011/0121010 A1 5/2011 Loftin et al.
2011/0121011 A1 5/2011 Gelardi et al.
2011/0121022 A1 5/2011 Sholl et al.
2012/0018391 A1 1/2012 Gelardi et al.
2012/0074016 A1 3/2012 Gelardi et al.
2012/0074160 A1 3/2012 Thomas et al.
2012/0074164 A1 3/2012 Walling et al.

(56) References Cited

U.S. PATENT DOCUMENTS

| | | | |
|---|---|---|---|
| 2012/0080513 | A1 | 4/2012 | Thomas et al. |
| 2012/0097694 | A1 | 4/2012 | Gelardi |
| 2012/0152970 | A1 | 6/2012 | Thomas |
| 2012/0211522 | A1 | 8/2012 | Gelardi et al. |
| 2012/0217213 | A1 | 8/2012 | Thomas |
| 2012/0217261 | A1 | 8/2012 | Bailey et al. |
| 2012/0223090 | A1 | 9/2012 | Thomas et al. |
| 2012/0279893 | A1 | 11/2012 | Gelardi et al. |
| 2012/0285976 | A1 | 11/2012 | Bogdziewicz et al. |
| 2012/0285977 | A1 | 11/2012 | Bates et al. |

FOREIGN PATENT DOCUMENTS

| | | | |
|---|---|---|---|
| DE | 29808673 | | 11/1998 |
| DE | 19808162 | | 9/1999 |
| DE | 20111307 | | 10/2001 |
| DE | 202007012114 | | 11/2007 |
| FR | 2415051 | | 8/1979 |
| GB | 1283210 | | 7/1972 |
| GB | 2190906 | | 12/1987 |
| GB | 2303624 | | 2/1997 |
| JP | 03105494 | A | 5/1991 |
| JP | 03133737 | A | 6/1991 |
| JP | 03198192 | A | 8/1991 |
| JP | 03273469 | A | 12/1991 |
| JP | 03273470 | A | 12/1991 |
| JP | 03273471 | A | 12/1991 |
| JP | 03273472 | A | 12/1991 |
| JP | 03273474 | A | 12/1991 |
| JP | 03273476 | A | 12/1991 |
| JP | 03273477 | A | 12/1991 |
| JP | 03273480 | A | 12/1991 |
| JP | 03273482 | A | 12/1991 |
| JP | 03273483 | A | 12/1991 |
| JP | 04086985 | A | 3/1992 |
| JP | 04115392 | A | 4/1992 |
| JP | 04137194 | A | 5/1992 |
| JP | 05004640 | A | 1/1993 |
| JP | 05174239 | A | 7/1993 |
| JP | 05346984 | A | 12/1993 |
| JP | 08161611 | A | 6/1996 |
| JP | 09027066 | A | 1/1997 |
| JP | 09102065 | A | 4/1997 |
| JP | 09282537 | A | 10/1997 |
| JP | 09311971 | A | 12/1997 |
| JP | 10269421 | A | 10/1998 |
| JP | 11011471 | A | 1/1999 |
| JP | 11171264 | A | 6/1999 |
| JP | 11191175 | A | 7/1999 |
| JP | 11328513 | A | 11/1999 |
| JP | 2001072076 | A | 3/2001 |
| JP | 2001206358 | A | 7/2001 |
| JP | 2003327243 | A | 11/2003 |
| JP | 2004017970 | A | 1/2004 |
| JP | 2005338910 | A | 12/2005 |
| JP | 04157593 | B1 | 10/2008 |
| WO | WO-9106076 | A1 | 5/1991 |
| WO | WO9321074 | | 10/1993 |
| WO | WO9423619 | | 10/1994 |
| WO | WO0054632 | | 9/2000 |
| WO | WO2004014755 | | 2/2004 |
| WO | WO 2004113808 | | 12/2004 |
| WO | WO2009029603 | | 3/2009 |
| WO | WO 2009138538 | | 11/2009 |
| WO | WO2011025483 | | 3/2011 |
| WO | WO2011030320 | | 3/2011 |
| WO | WO2011109350 | | 9/2011 |

OTHER PUBLICATIONS

International Search Report and Written Opinion issued in PCT/US2010/057221 (Mar. 4, 2011).

Felix Austria Gmbh, "Behalter Fur Verkaufsartikel." AT6036U1, published Mar. 25, 2003.

Voshenrich Udo, "Presentationsbehalter." DE19808162, published Sep. 9, 1999.

Rademacher Herbert, "Anordnung Zum Entnehmen Von Auf Einem Wickel Aufgewickelten Einkaufstaschen." DE20111307, published Oct. 11, 2001.

Knauer Hans Georg, "Presentationskarton Fur Einen Helm Und Versandkarton Fur Einen Solchen Helm." DE202007012114, published Nov. 8, 2007.

Hubert Peter, "Tragbare Flaschenverpackung." DE2655496, published Jun. 15, 1978.

Renz Andreas ; Renz Edgar, "Untersatz Fur Einen Flaschenkasten." DE29808673, published Nov. 5, 1998.

Mourot Jacques, "Boite Distributrice Pour Produits En Morceaux." FR2415051, published Aug. 17, 1979.

Laurent Jean Hubert, "Improvements In Or Relating To Self-Service Distributing Apparatus." GB1283210, published Jul. 26, 1972.

Kuenzel Werner; Roth Martin, "Folding Box With Push-In Tab." WO1993021074, published Oct. 28, 1993.

Akberali Hassan Badruding, "Cabinets For Foodstuffs In Containers." WO1994023619, published Oct. 27, 1994.

Couture David Gerard; Tracy Stephen Joseph, "Display System For Advancing Products." WO2000054632, published Sep. 21, 2000.

Smalley Brian Leslie; Wilkins Zoe, "Dispensing Package." WO2004014755, published Feb. 19, 2004.

Learn Angela Elizabeth, "Carton For Dispensing Products And Method Of Using The Same." WO2009029603, published Mar. 5, 2009.

Bauer Jamie, "Product Dispenser Assembly And Cartridge for Holding Product." WO2011025483, published Mar. 3, 2011.

Marais Hendrik Dawid, "Modular Display And Dispensing Arrangement." WO2011030320, published Mar. 17, 2011.

Loftin Caleb S; Bates Aaron, "Devices For Dispensing And Displaying Products And Package Assemblies For Use With The Same." WO2011109350, published Sep. 9, 2011.

* cited by examiner

DISPENSING SYSTEM AND PACKAGE FOR USE THEREWITH

BACKGROUND

Point-of-sale (P.O.S.) or display units have continued to gain an increasing use in retail outlets because they present articles and products in an eye-catching and easily accessible manner. They also function as a storage area for products until the products are selected and taken away by customers. As products are removed, it is desirable for the shelf to present the next stored article being forwardly tilled for easy selection by customers. Some dispensers have sprung-biased mechanisms that push products forward. Some other known display devices use gravity feed mechanisms to cause products to flow to the forward-most sale position.

U.S. Pat. No. 5,396,997 discloses a dispensing device having upper and lower jar guides with a plurality of glass jar containers loaded on their sides through a container loading area. The dispenser racks successively feed one container at a time to the container dispensing area to thereby provide a self-feeding and self-facing storage, dispensing and display system. One drawback of such system is that loading of the dispensing device must be done manually and individually. Thus, it is labour intensive and time consuming to load such dispensing device at the retail stores.

U.S. Pat. No. 7,922,437 discloses an improved dispensing system for dispensing a plurality of products. The system includes: a dispensing frame having side walls, an upper support, and a product display area; a carton package having a weakened severance line on it bottom panel; and an opening tool associated with the frame that severs the weakened severance line on the bottom panel of the carton when the carton is moved longitudinally along the frame, thereby allowing the products to be at least partially dispensed vertically downward from the bottom of the package into the product display area.

It is beneficial to have a dispensing system for dispensing a plurality of products wherein the packaged products may be dispensed from the carton in other directions, such as from the rear panel of the carton or from the angular angle of the back and side panels.

SUMMARY

Disclosed is an improved system for dispensing products provided initially in a package. The package includes an activatable opening structure that forms an opening that allows products to at least partially exit the package along the longitudinal, loading axis.

In one aspect, the dispensing system includes (1) a frame being configured to support a package of products and including a front end section and a rear end section, the front end section being opposed from the rear end section along a longitudinal axis, a support deck extending at least partially between the front end section and the rear end section, and a product display area; and (2) an opening tool associated with the frame, the opening tool engaging an activatable opening structure on the package to create an opening when the package is moved longitudinally along the support deck, thus allowing at least one of the products to longitudinally move along the axis at least partially through the opening.

In another aspect, the dispensing system includes a frame being configured to support the package of products and an opening tool associated with the frame. The opening tool engages with the activatable opening structure on the package to create an opening when the package is moved longitudinally along the frame of the dispensing system, thus allowing the products to be at least partially dispensed out of the package into the product display area of the frame through the opening formed on the rear panel or on an angular of the rear and side panels of the package.

DETAILED DESCRIPTION

Detailed descriptions of specific embodiments of the dispensing device apparatus and packages are disclosed herein. It will be understood that the disclosed embodiments are merely examples of the way in which certain aspects of the disclosure can be implemented and do not represent an exhaustive list of all of the ways the disclosure may be embodied. Indeed, it will be understood that the apparatus and packages described herein may be embodied in various and alternative forms. The figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the disclosure.

In a first aspect, the disclosed dispensing system may be configured as a front-loading dispensing system, wherein a package may be loaded onto the frame of the dispensing system by moving the package from the front of the frame toward the rear of the frame. As the package moves toward the rear of the frame, the opening tool of the dispensing system may engage the package to form an opening in the rear of the package, and products housed in the package may longitudinally move through the opening (at least partially) before dropping from the upper level to the lower level of the frame and, ultimately, moving to the product display area of the frame.

In one embodiment of the first aspect, a dispensing system for dispensing products provided initially in a package is disclosed, wherein the package includes a series of panels including opposed front and rear panels, opposed side panels, and opposed top and bottom panels, and an activatable opening structure on at least one of the panels, the dispensing system including:

(a) a frame being configured to support the package of products and including:
  (i) longitudinally opposed front and rear end sections, and
  (ii) a support deck extending at least partially between the front and rear end sections and below which a product display area is provided; and
(b) an opening tool associated with the frame, wherein the opening tool engages with the activatable opening structure on the package to create an opening when the package is moved longitudinally along the frame, thus allowing the products to be at least partially dispensed into the product display area of the frame through the opening formed at least in the rear panel of the package.

Figure 1:
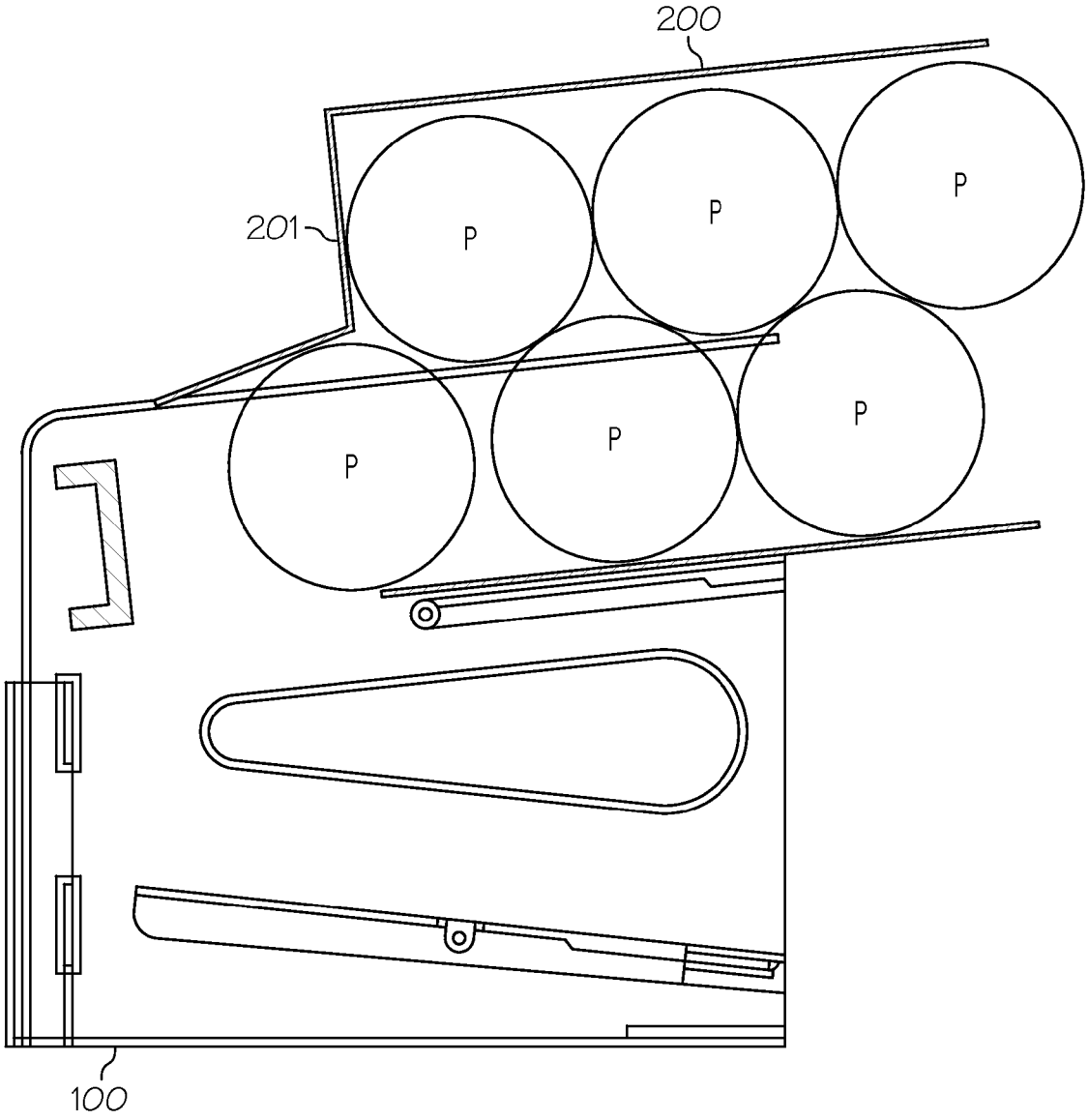
FIG. 1 illustrates one embodiment of the disclosed dispensing system, wherein the packaged products are dispensed from the rear panel of the package into the product display area.

FIG. 1 shows one particular embodiment of the disclosed dispensing system. The dispensing system includes a frame 100 configured to support the package 200 housing products P, and an opening tool (not shown in FIG. 1) associated with the frame 100. The package 200 includes an activatable opening structure 201 on its rear panel. The opening tool engages the activatable opening structure 201 on the rear panel of the package to form an opening when the package is moved longitudinally along the frame, thereby allowing the products to be at least partially dispensed from the package, through the opening, and into the product display area.

Figure 2:
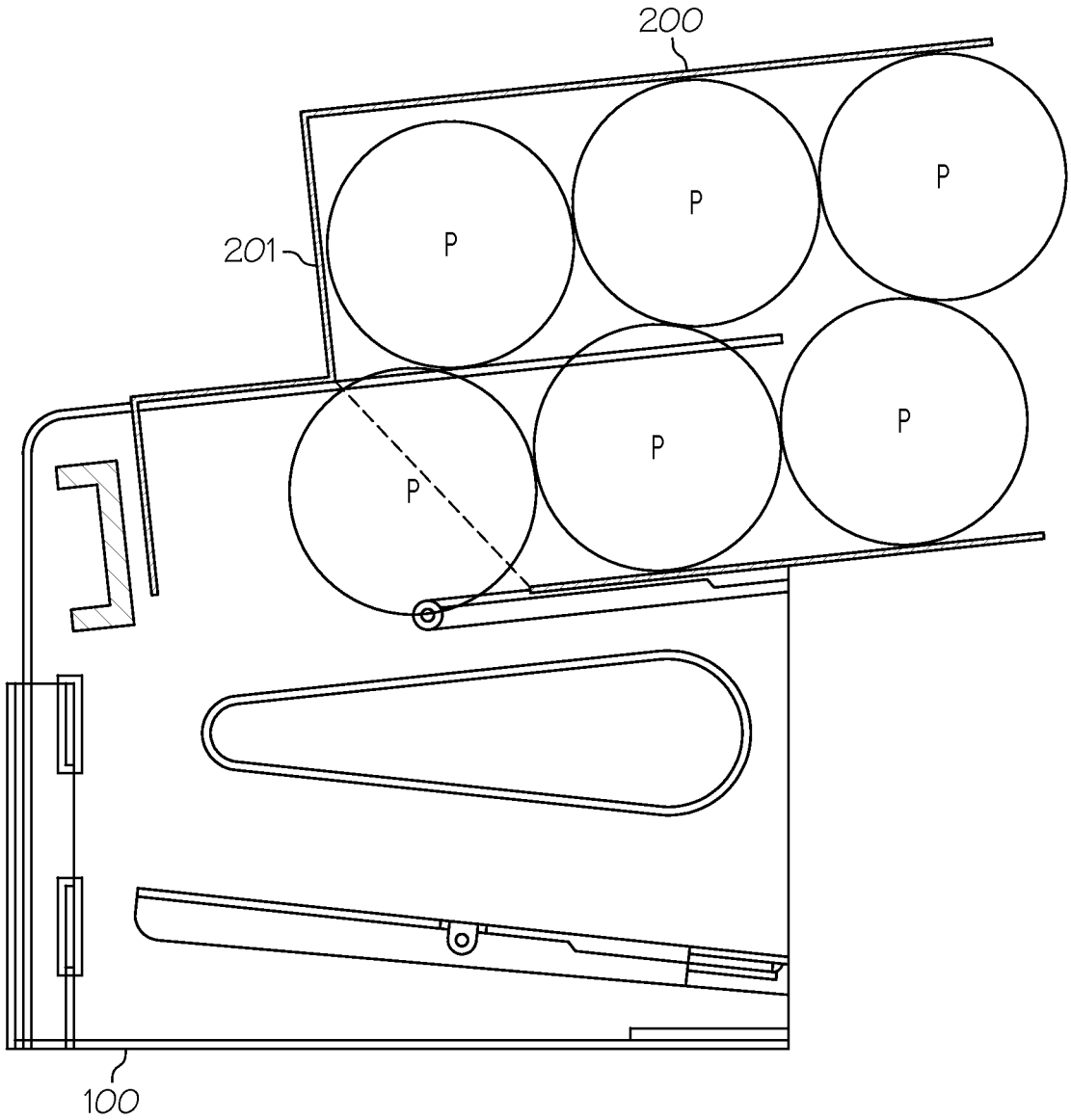
FIG. 2 illustrates another embodiment of the disclosed dispensing system, wherein the packaged products are dispensed from the rear and side panels of the package.

FIG. 2 shows another embodiment of the disclosed dispensing system. The dispensing system includes a frame 100 configured to support the package 200 housing products P, and an opening tool (not shown in FIG. 2) associated with the frame. The package 200 includes an activatable opening structure 201 such that once the package 200 is loaded onto the frame 100 and moved longitudinally along the frame, the activatable opening structure 201 on the package engages with the opening tool for forming an opening in the package, thus allowing products P to be at least partially dispensed through the opening from an angular portion of the rear and side panels of the package into the product display area of the frame. When desired, the angular plane for the opening may be 45 degree between the rear and side panels of the package.

Figure 3A:
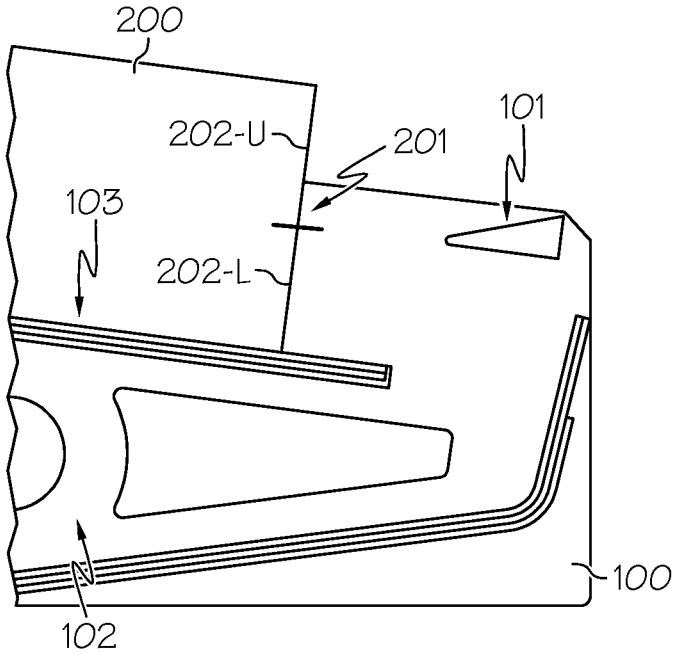
FIGS. 3A to 3D illustrate perspective and side views of the disclosed dispensing system according to one embodiment, showing an engagement of the opening tool to the weakened severance line on the rear panel of the package.
Figure 3B:
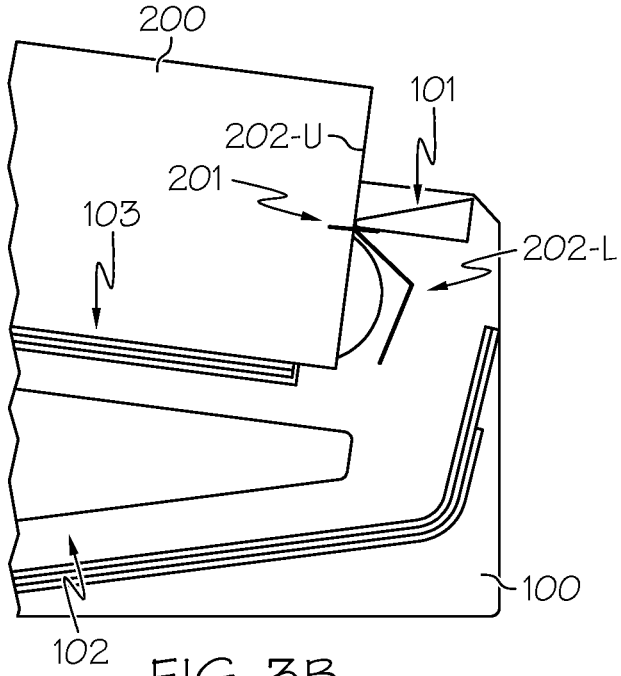
Figure 3C:
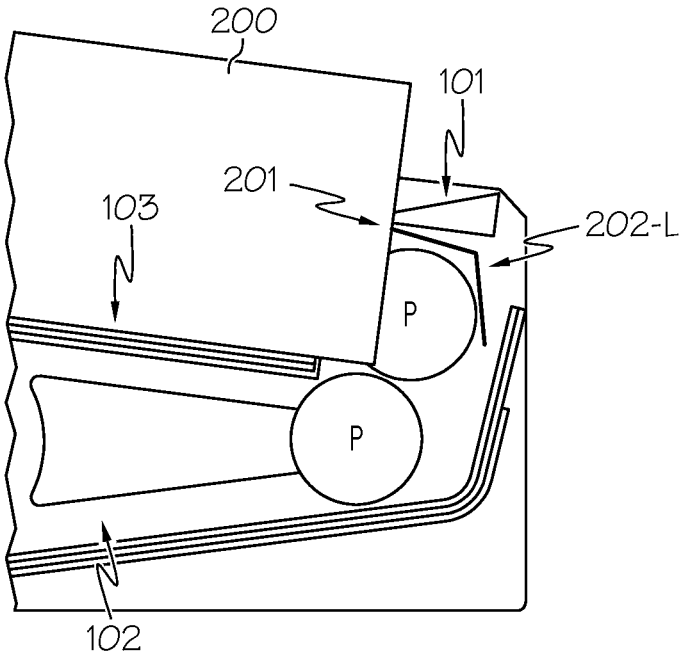
Figure 3D:
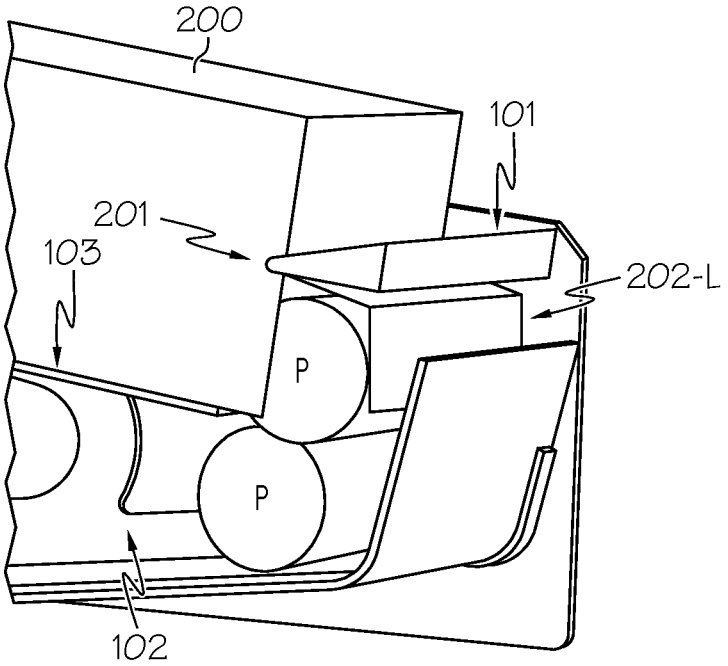

FIGS. 3A-3D illustrate the dispensing of products from a dispensing system according to another embodiment of the present disclosure. The dispensing system includes a frame 100 being configured to support the package 200 of products P and an opening tool 101. The frame includes longitudinally opposed front and rear end sections and an upper support deck 103 extending at least partially between the front and rear end sections and below which a product display area 102 is provided. The package 200 includes an activatable opening structure 201 at its rear panel 202. The opening tool 101 on the frame 100 may be a protrusion, and the activatable opening structure 201 may be in the form of a crease, a frangible line or a weakened severance line at the rear panel 202 dividing the rear panel into the upper portion 202-U and the lower portion 202-L. As the package 200 is loaded onto the frame 100 and moved longitudinally towards the opening tool 101 (FIG. 3A), the opening tool 101 engages the activatable opening structure 201 on the rear panel 202 of the package and severs the weakened severance line such that the bottom portion 202-L of the rear panel is opened (FIG. 3B). Consequently, the products P are dispensed out of the package 200, through the opening (FIGS. 3C and 3D) between the upper and lower levels, and to the product display area 102 of the frame 100.

Figure 4A:
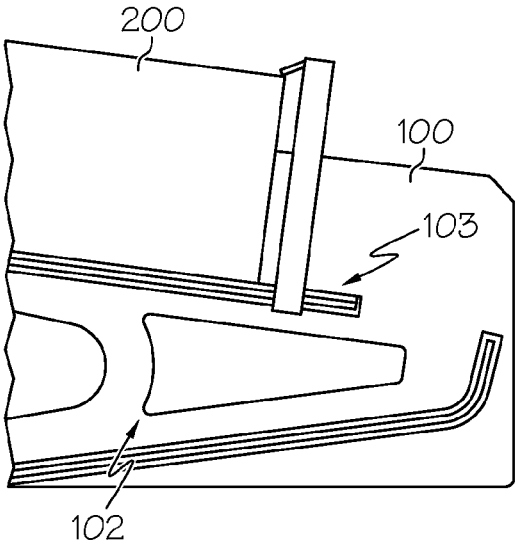
FIG. 4A shows a side view of a dispensing system according to another embodiment of the disclosure.
Figure 4B:
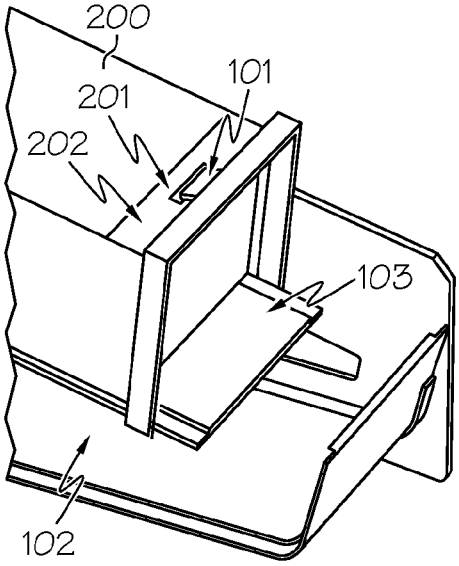
FIG. 4B shows a perspective view of the dispensing system in FIG. 4A, showing an engagement between the opening tool of the dispensing system and the activatable opening structure of the package as the package is moved longitudinally along the frame toward the opening tool.

FIGS. 4A-4C and 5A-5C illustrate the dispensing of the products from the dispensing system according to another embodiment of the present disclosure. FIGS. 4A and 4B show a side view and a perspective view of such dispensing system respectively.

Figure 4C:
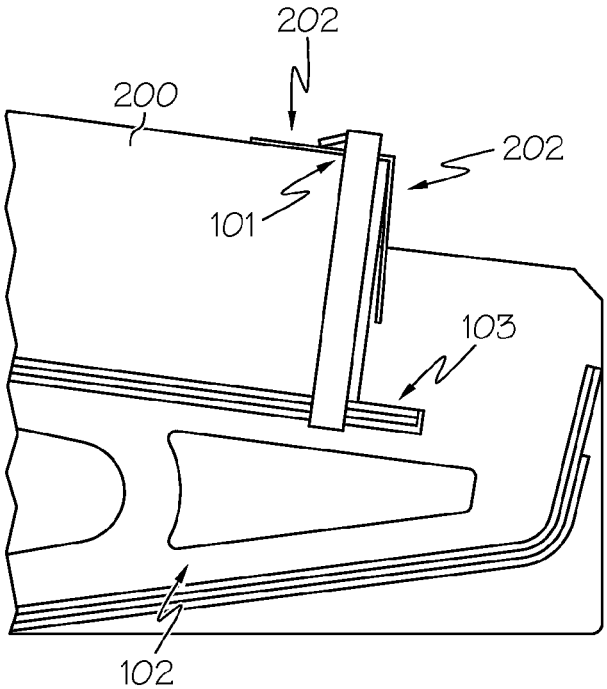
FIG. 4C shows a side view of the dispensing system in FIG. 4A, when the package is moved longitudinally along the support deck of the dispensing system toward the opening tool.
Figure 5A:
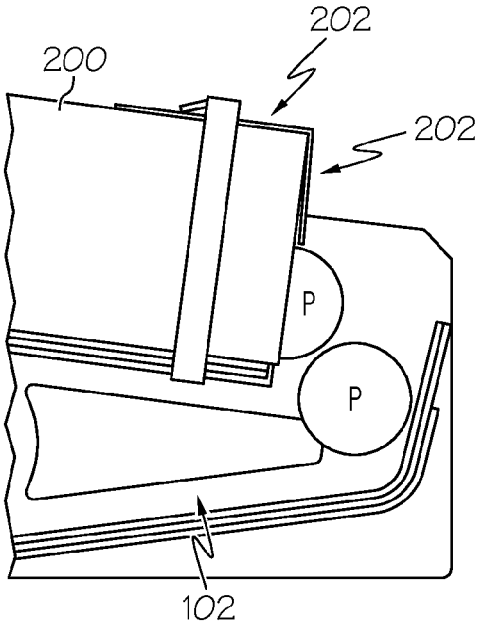
FIGS. 5A to 5C show side and perspective views of the dispensing system in FIG. 4C as the package is further moved longitudinally along the support deck of the dispensing system, showing the packaged products dispensed from the rear panel of the package.
Figure 5B:
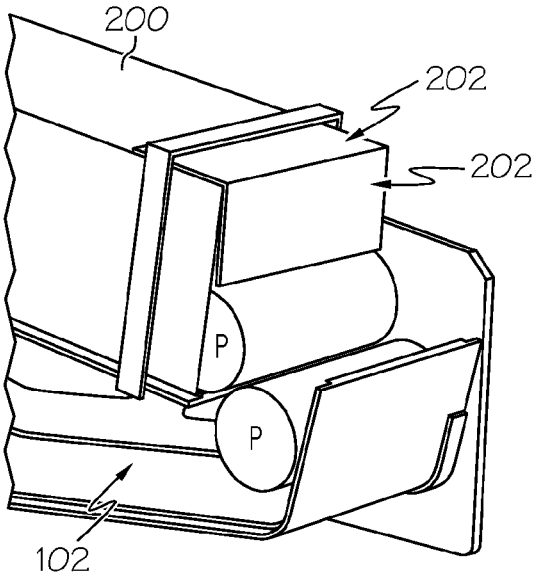
Figure 5C:
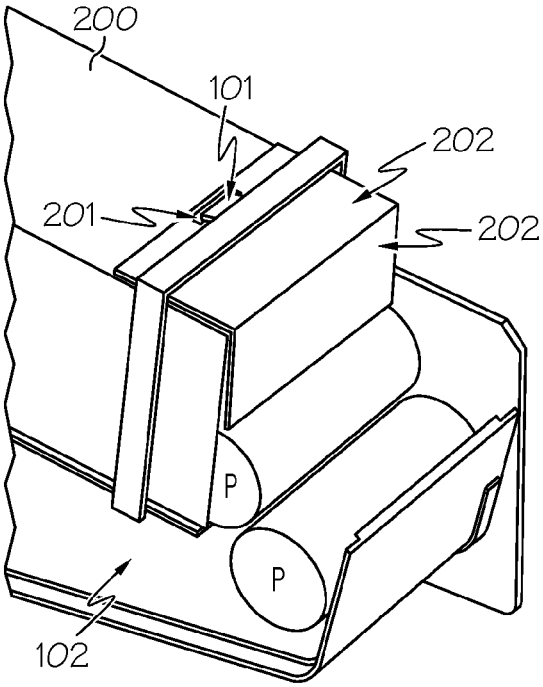

The package 200 includes a series of panels including a rear panel 202, and an activatable opening structure 201. The frame 100 of the dispensing system includes an upper support deck 103 to support the package 200 once it is loaded onto the dispensing system, a product display area 102, and an opening tool 101 to engage with the activatable opening structure 201 on the package 200. When the package 200 is loaded onto the dispensing system and moved longitudinally on the upper support deck 103 towards the opening tool 101, the opening tool 101 engages with the activatable opening structure 201 on the package 200. Referring to FIG. 4C, as the package 200 is moved further along the upper support deck 103, the engagement between the opening tool 101 and activatable opening structure 201 causes at least a portion of the rear panel 202 to slide over onto the top panel of the package such that the opening is created at the rear end of the package. As shown in FIGS. 5A to 5C, the products P then may be dispensed through the opening at the rear end of the package onto the product display area 102 of the frame 100.

In one embodiment of the dispensing system shown in FIGS. 4A-4C and 5A-5C, the activatable opening structure may be a flap or aperture on the rear panel of the package. The opening tool on the dispensing system engages with the flap or aperture on the package upon loading the package into the dispensing system. As the package is further moved longitudinally along the upper support deck, the engagement between the opening tool and the flap or aperture causes the rear panel to slide upward, revealing the opening area for the products to dispense out of the package into the display area of the dispensing system.

When desired, the package suitable for use with the dispensing system of FIGS. 4A-4C may further include a removable tear strip on the rear panel of the package. The removable tear strip may be removed from the rear panel of the package prior to loading the package onto the dispensing system.

Figure 6A:
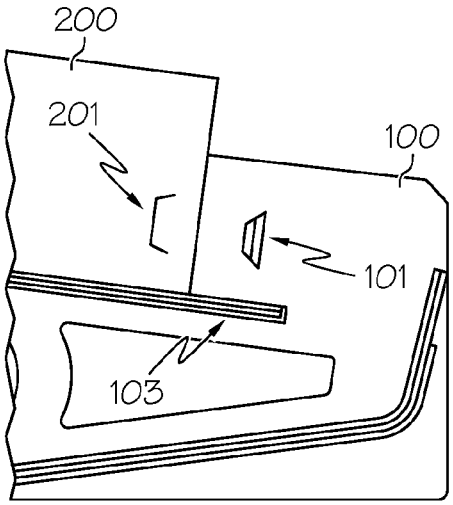
FIGS. 6A and 6B show side and perspective views of a dispensing system according to another embodiment of the disclosure, illustrating the activatable opening structure of the package and an opening tab of the dispensing system capable of engaging with the activatable opening structure.
Figure 6B:
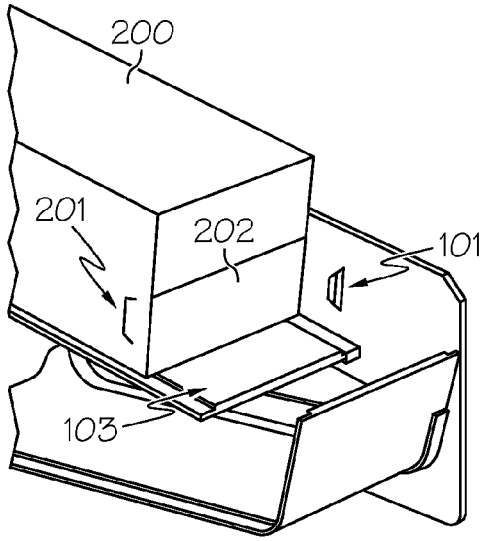
Figure 6C:
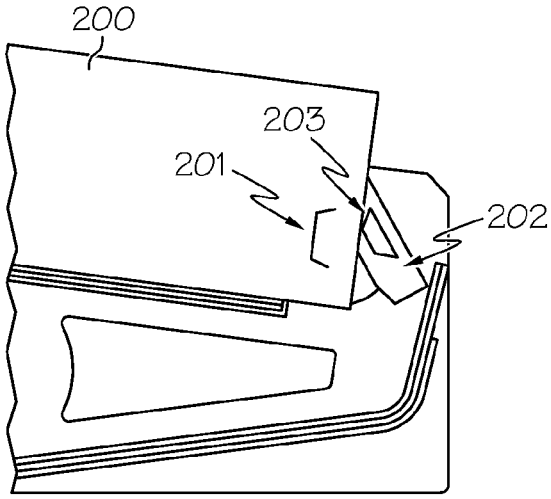
FIGS. 6C to 6D show side and perspective views of the dispensing system in FIG. 6A as the package is further moved longitudinally along the support deck of the dispensing system.
Figure 6D:
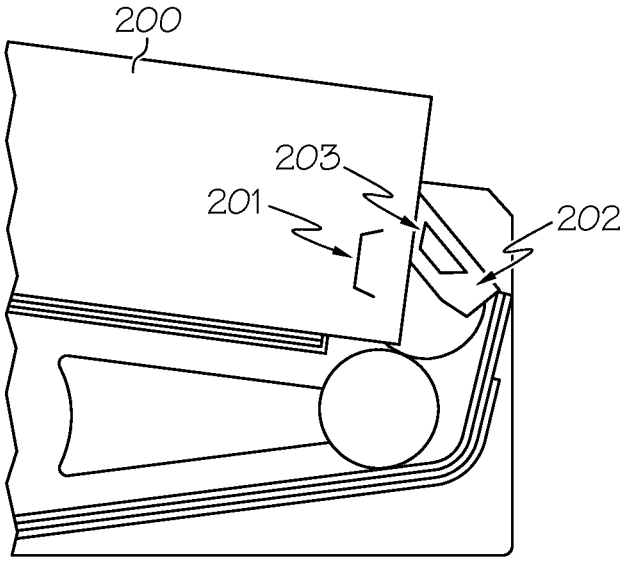
Figure 6E:
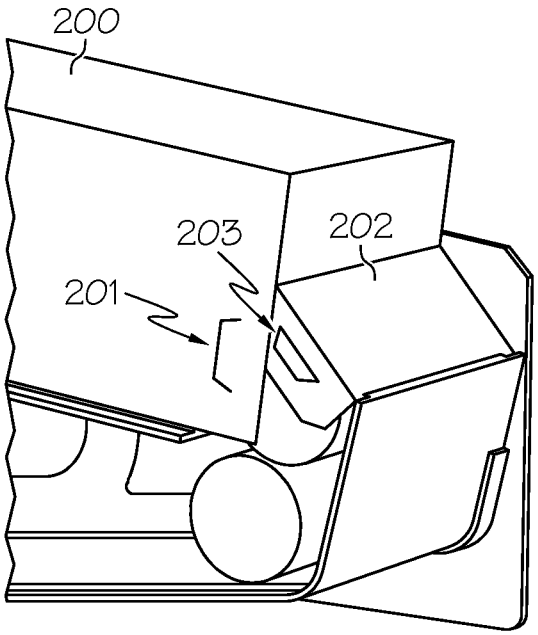

FIGS. 6A to 6E illustrate the dispensing of the products from the dispensing system according to another embodiment of the present disclosure. FIGS. 6A and 6B show side and perspective views of the disclosed dispensing system respectively. The package 200 may include a plurality of panels, including opposed side panels and a rear panel 202; an activatable opening structure 201 on each side panel; and a locking tab 203 (shown in FIG. 6C) releasably engaged with the activatable opening structure 201. The frame 100 of the dispensing system may include: an upper support deck 103 to support the package 200 once it is loaded onto the dispensing system; a product display area 102; and an opening tool 101 to engage with the activatable opening structure 201 on the package 200. When the package 200 is loaded onto the dispensing system and moved longitudinally on the upper support deck 103 towards the opening tool 101, the opening tool 101 engages with the activatable opening structure 201 on the package 200. In turn, the activatable opening structure 201 engages with the locking tab 203 to release at least a portion of the rear panel 202 such that an opening is created at the rear end of the package as shown in FIG. 6C. Consequently, the products P may be dispensed out of the package through the opening from the rear end of the package to the product display area of the dispensing system as shown in FIGS. 6D and 6E.

In one embodiment of the dispensing system shown in FIG. 6, the activatable opening structure on the package and the opening tool on the dispensing system may be in the form of reciprocal lock and release structures.

FIGS. 7A to 7D illustrate the dispensing of the products from the dispensing system according to another embodiment of the present disclosure, wherein the products are dispensed from the rear corner of the package through a "push in and pull back" motion.

Figure 7A:
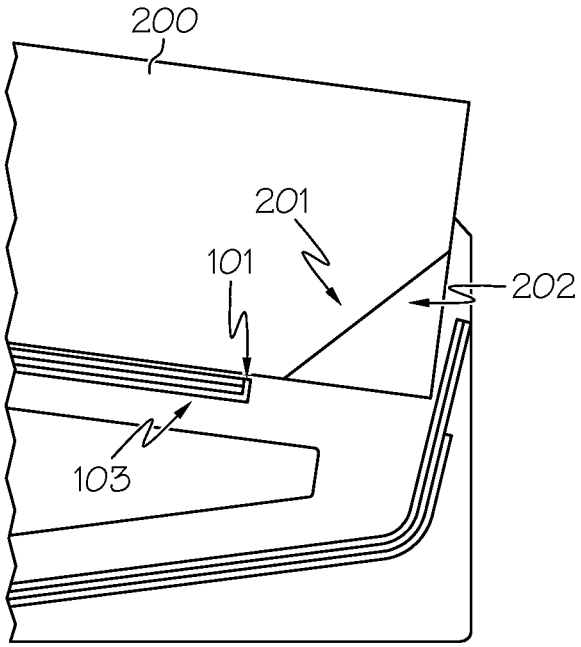
FIGS. 7A to 7D show side views of a dispensing system according to another embodiment of the disclosure, illustrating the engagement between the activatable opening structure of the package and the opening tool of the dispensing system that creates the opening on the rear corner of the package through which the products are dispensed from the package into the product display area of the dispensing system.
Figure 7B:
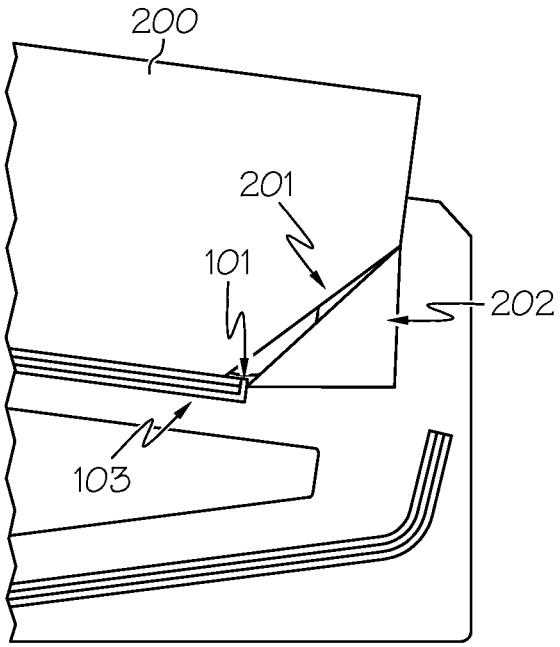
Figure 7C:
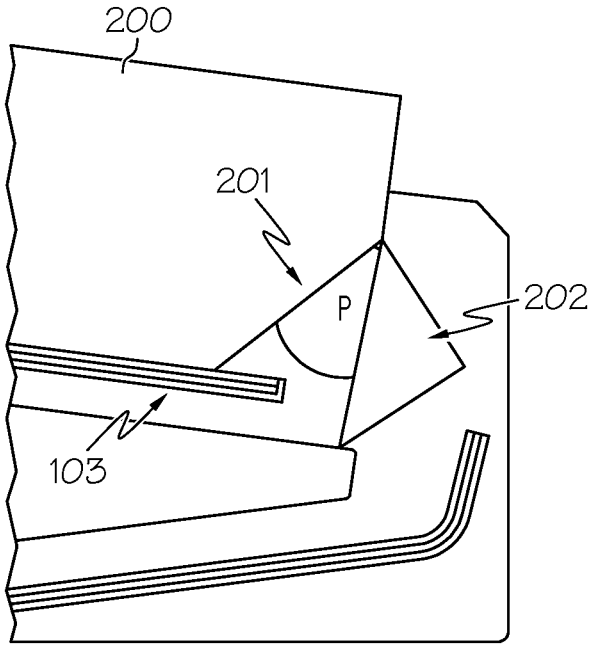
Figure 7D:
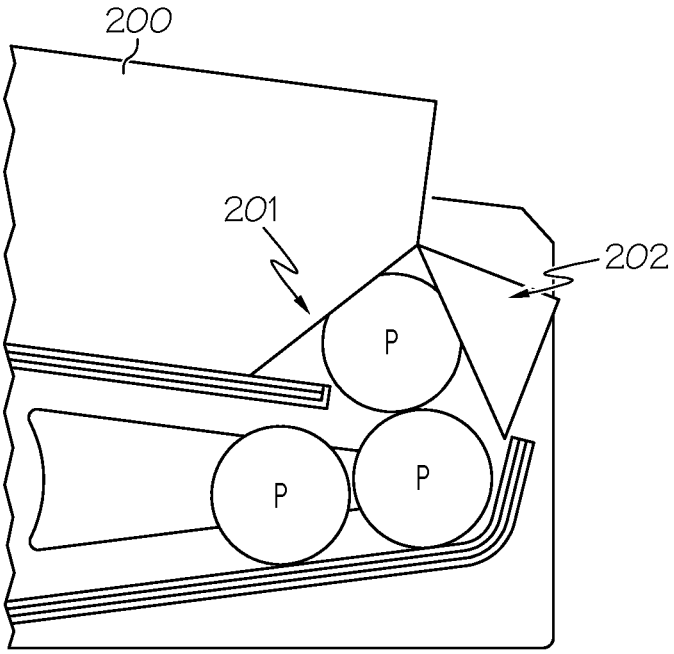

FIG. 7A shows a side view of such dispensing system embodiment. The package 200 may include: a series of panels including a bottom panel and a rear panel 202; and an activatable opening structure 201 on the package panels. The frame 100 of the dispensing system may include: an upper support deck 103 to support the package 200 once it is loaded onto the dispensing system; a product display area; and an opening tool 101 to engage with the activatable opening structure 201 on the package 200. First, the package 200 is loaded onto the dispensing system by placing on the upper support deck 103 as shown in FIG. 7A. Then, the package 200 is moved longitudinally by "pulling forward" along the support deck 103 such that the opening tool 101 engages with the activatable opening structure 201 on the package 200 and the opening is created on the package as shown in FIG. 7B. Subsequently, the package 200 is "pushed back" along the support deck 103 (FIG. 7C) to enlarge the formed opening. As the package 200 is further "pushed back" along support deck 103 (FIG. 7D), the opening becomes bigger in size and allows the products to be dispensed out of the package through the opening into the product display area of the dispensing system. In one embodiment, the activatable opening structure may be a flap on the bottom panel of the package. In one embodiment, the activatable opening structure may be a crease, frangible or weaken line that is severable upon engaging with the opening tool on the dispensing system by a "push in and pull back" motion of the loaded package along the upper support deck.

It is to be understood that only some embodiments of the disclosed dispensing systems are shown. Other structures of the opening tools on the dispensing systems and/or the activatable opening structures on the package may be used in the present disclosure without departing from the scope of the present disclosure. These structures may be modified to accommodate the end use applications of the packages.

One skilled in the art will readily recognize that other shapes and sizes of the dispensing systems and the packages may be used. Additionally, the disclosed dispensing systems and/or the packages for use therewith may accommodate more than one product in different arrays.

In another embodiment of the disclosed dispensing system, the frame may further include a lower display deck associated with the product display area.

In another embodiment of the disclosed dispensing system, the frame may further include a rear wall configured to guide the products to the product display area.

In another embodiment of the disclosed dispensing system, the upper support deck may be inclined at an acute angle with respect to a horizontal plane.

In another embodiment of the disclosed dispensing system, the opening tool may be integrally connected to the frame.

In another embodiment of the disclosed dispensing system, the opening tool may be removably connected to the frame.

In another embodiment of the disclosed dispensing system, the frame may further include first and second laterally opposed side walls adapted and configured for guiding the package as it is moved longitudinally along the upper support deck.

In another embodiment of the disclosed dispensing system, the frame may further include a lane divider to create two display channels within the product display area.

In a second aspect, the disclosed dispensing system may be configured as a rear-loading dispensing system, wherein a package may be loaded onto the frame of the dispensing system by moving the package from the rear of the frame toward the front of the frame. As the package reaches the front of the frame, the opening tool of the dispensing system may engage the package to form an opening in the front of the package, and products housed in the package may longitudinally move through the opening (at least partially) before transitioning to the product display area of the frame.

A rear-loading dispenser is disclosed in U.S. Ser. No. 13/039,667 filed on Mar. 3, 2011, the entire contents of which are incorporated herein by reference.

The product display area of a rear-loading dispenser may be configured in various ways. The configuration of the product display area may depend on whether the frame includes a single support deck or multiple support decks (e.g., a lower support deck positioned below an upper support deck).

In one construction, the product display area may be positioned below the support deck. Therefore, product longitudinally moving through the opening in the front of the package may eventually drop below the support deck to the product display area.

Figure 8:
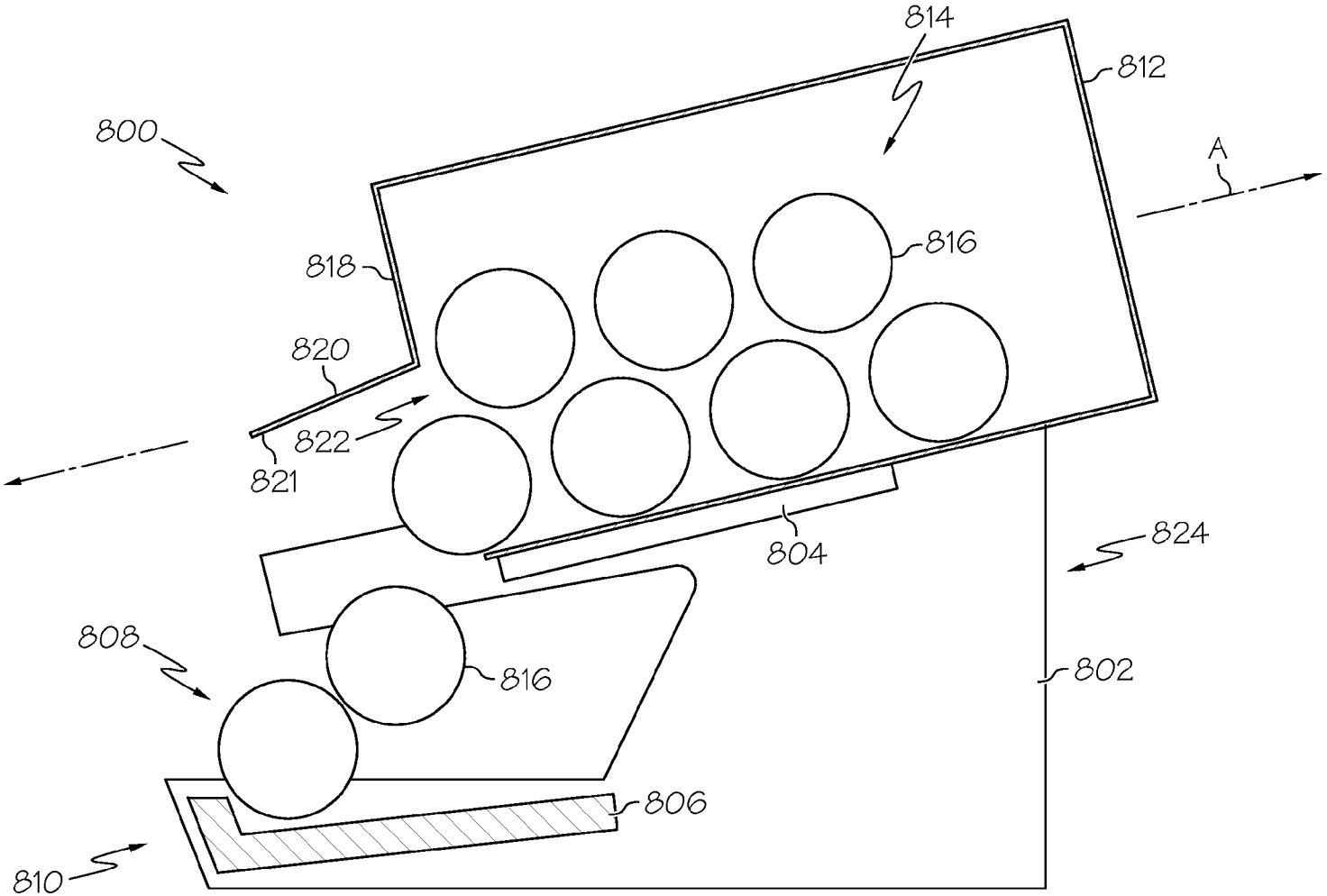
FIG. 8 illustrates yet embodiment of the disclosed dispensing system, wherein the packaged products are dispensed from the front panel of the package into the product display area.

As shown in FIG. 8, the dispensing system 800 may include a frame 802 and an opening tool (not shown in FIG. 8) associated with the frame 802. The frame 802 may include an upper support deck 804 and a lower support deck 806, and the lower support deck 806 may define a product display area 808 proximate the front end section 810 of the frame 802. Those skilled in the art will appreciate that the opening tools described above may be adapted for use with dispensing system 800.

A package 812 comprised of a plurality of walls may define an internal volume 814, and may house a plurality of products 816 in the internal volume 814. The front wall 818 of the package 812 may define an activatable opening structure 820 that, when engaged by the opening tool, forms an opening 822 in the package 812.

Thus, the package 812 may be loaded onto the frame 802 by urging the package 812 along the upper support deck 804 from the rear end section 824 toward the front end section 810 of the frame 802 along the longitudinal, loading axis A. As the package longitudinally moves toward the front end section 810 of the frame 802, the opening tool associated with the frame 802 may engage the activatable opening structure 820 to form the opening 822. For example, as shown in FIG. 8, engagement between the opening tool and the activatable opening structure 820 may free a pivoting flap 821, and the force of products 816 moving into engagement with the flap 821 under the force of gravity may cause the flap 821 to swing outward from the package 812 such that the products may move through the opening 822.

As is shown in FIG. 8, products 816 exiting the package 812 may initially move along the longitudinal, loading axis A as they travel through the opening 822. Then, after a certain amount of longitudinal movement, the products 816 may vertically drop from the upper support deck 804 down to the lower support deck 806 and, ultimately, to the product display area 808.

In another construction, the product display area may be positioned in front of the opening in the package on the same level as the support deck. Therefore, product may longitudinally move from the package, through the opening, and directly to the product display area, without the need for the product to drop from the support deck to another level.

Accordingly, the disclosed dispensing system may form an opening in a package such that products move along the longitudinal axis of the frame as they pass through the opening. The opening may be either at the rear or the front of the package depending on whether the system is configured as a front-loading or rear-loading system, respectfully. Optionally, after longitudinally moving at least partially through the opening, the products may vertically drop down to the lower level of the frame as they move to the product display area.

While the disclosure has been described by reference to various specific embodiments, it should be understood that numerous changes may be made within the spirit and scope of the inventive concepts described. It is intended that the disclosure not be limited to the described embodiments, but will have full scope defined by the language of the following claims.

What is claimed is:

1. A system for dispensing products provided initially in a package, wherein the package comprises a plurality of panels and an activatable opening structure on at least one panel of the plurality of panels, the dispensing system comprising:

(a) a frame being configured to support the package of products and including:

(i) a first end section and a second end section, the first end section being opposed from the second end section along a longitudinal axis, (ii) a support deck extending at least partially between the first end section and the second end section, and (iii) a product display area; and (b) an opening tool associated with the frame, the opening tool engaging the activatable opening structure on the package to create an opening when the package is moved longitudinally along the support deck, thus allowing at least one of the products to longitudinally move along the axis at least partially through the opening and, ultimately, to the product display area.

2. The system of claim 1, wherein the product display area is positioned proximate the first end section.

3. The system of claim 1, wherein the product display area is positioned below the support deck.

4. The system of claim 1, wherein the package comprises opposed front and rear panels, opposed side panels and opposed top and bottom panels, and wherein the opening is formed at least in the rear panel.

5. The system of claim 1, wherein the package comprises opposed front and rear panels, opposed side panels and opposed top and bottom panels, and wherein the opening is formed at least in the front panel.

6. The system of claim 1, wherein:

the opening tool includes a protrusion; and the activatable opening structure includes at least one of a crease line, a frangible line, and a weakened line, wherein, upon moving the package longitudinally towards the opening tool, the opening tool severs the line to create the opening on the package for dispensing the products.

7. The system of claim 1, further comprising the package containing products.

8. The system of claim 1, wherein the opening tool is integrally connected to the frame.

9. The system of claim 1, wherein the opening tool is removably connected to the frame.

10. The system of claim 1, wherein the opening tool includes a protrusion.

11. The system of claim 1, wherein the activatable opening structure includes at least one of a crease line, a frangible line, a weakened line, and a flap.

12. The system of claim 1, wherein the opening tool is vertically displaced from the support deck.

13. A method of dispensing products provided initially in a package, the method comprising steps of:

(1) providing a frame configured to support the package of products, the frame including:

(a) a first end section and a second end section, the first end section being opposed from the second end section along a longitudinal axis, (b) a support deck extending at least partially between the first end section and the second end section, and (c) a product display area;

(2) associating an opening tool with the frame;

(3) loading the package onto the frame, the package including:

(a) a plurality of panels; and (b) an activatable opening structure on at least one panel of the plurality of panels; and (4) moving the package longitudinally along the support deck such that the opening tool engages the activatable opening structure to form an opening, wherein at least one of the products longitudinally moves along the axis at least partially through the opening and, ultimately, to the product display area.

14. The method of claim 13, wherein the product display area is positioned below the support deck and proximate the first end section, and wherein the at least one product drops down to the product display area after longitudinally moving along the axis at least partially through the opening.

15. The method of claim 13, wherein the package comprises a front panel, a rear panel, a first side panel, a second side panel, a top panel and a bottom panel, the front panel being opposed from the rear panel, the first side panel being opposed from the second side panel and the top panel being opposed from the bottom panel, and wherein the opening is formed at least in the rear panel.

16. method of claim 13, wherein the opening tool includes a protrusion.

17. The method of claim 13, wherein the activatable opening structure includes at least one of a crease line, a frangible line, a weakened line, and a flap.

18. The method of claim 13, wherein the opening tool is vertically displaced from the support deck.

19. A dispensing system comprising:

a frame including:

a first end section and a second end section, the first end section being opposed from the second end section along a longitudinal axis, a support deck extending at least partially between the first end section and the second end section, the support deck defining an upper level, a lower level and an opening between the upper level and the lower level, wherein the opening is positioned proximate the second end section, and a product display area positioned in the lower level proximate the first end section; and an opening tool connected to the frame, wherein the opening tool is positioned in the upper level at least partially over the opening, and wherein the opening tool is vertically displaced from the support deck.

20. The dispensing system of claim 19, wherein the frame further includes laterally opposed side walls.

21. The dispensing system of claim 20, wherein the opening tool laterally extends between the side walls.

22. The dispensing system of claim 19, wherein the vertical displacement of the opening tool relative to the support deck is sufficient to allow a product to move between the opening tool and the support deck.

23. The dispensing system of claim 19, wherein the opening tool is wedge-shaped.

* * * * *